US006870159B2

(12) United States Patent
Kawato

(10) Patent No.: US 6,870,159 B2
(45) Date of Patent: Mar. 22, 2005

(54) ION TRAP DEVICE AND ITS TUNING METHOD

(75) Inventor: Eizo Kawato, Kyoto-fu (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 10/694,991

(22) Filed: Oct. 29, 2003

(65) Prior Publication Data

US 2004/0155183 A1 Aug. 12, 2004

(30) Foreign Application Priority Data

Oct. 31, 2002 (JP) ..... 2002-317723

(51) Int. Cl.[7] ..... H01J 49/42
(52) U.S. Cl. ..... 250/292; 250/282
(58) Field of Search ..... 250/292, 282; 324/322, 318

(56) References Cited

U.S. PATENT DOCUMENTS 4,959,543 A * 9/1990 McIver et al. ..... 250/291
5,451,782 A * 9/1995 Kelley ..... 250/282
5,468,957 A * 11/1995 Franzen ..... 250/282
5,528,031 A * 6/1996 Franzen ..... 250/282
5,714,755 A * 2/1998 Wells et al. ..... 250/281
6,118,276 A * 9/2000 Nakata et al. ..... 324/464
6,262,638 B1 * 7/2001 Scherer ..... 333/174
6,384,688 B1 * 5/2002 Fujioka et al. ..... 330/302
6,443,547 B1 * 9/2002 Takahashi et al. ..... 347/9
6,452,168 B1 * 9/2002 McLuckey et al. ..... 250/292

FOREIGN PATENT DOCUMENTS

JP 2002-533881 10/2002
WO WO 00/38312 6/2000

* cited by examiner

*Primary Examiner*—Nikita Wells
*Assistant Examiner*—Johnnie L Smith, II
(74) *Attorney, Agent, or Firm*—Westerman, Hattori, Daniels & Adrian, LLP

(57) ABSTRACT

The resonance frequency of the resonant circuit, which is used to apply the RF high voltage to an electrode of the ion trap device, is deliberately shifted from the frequency of the RF driver (driving frequency). This reduces the influence of the deviation in the resonance frequency caused by the change in the RF high voltage on the shift in the phase difference between the output of the RF driver and the RF high voltage. This minimizes the degradation of various performances of the ion trap device relating to the phase difference, such as the shift in the peaks of the mass spectrum, and enhances the precision and sensitivity of the mass analysis of the mass spectrometers using the ion trap device.

8 Claims, 2 Drawing Sheets

ION TRAP DEVICE AND ITS TUNING METHOD

The present invention relates to an ion trap device in which ions are trapped with a three-dimensional quadrupole electric field. Such an ion trap device, which may also be called simply as an "ion trap", are used for ion trap mass spectrometers, for the ion source of time-of-flight mass spectrometers, and for other ion analyzers.

BACKGROUND OF THE INVENTION

In an ion trap device, ions are trapped by a three-dimensional quadrupole electric field formed by a combination of an RF (radio frequency) electric field and a DC (direct current) electric field. There are some types of ion trap device, including one using electrodes having hyperboloid-of-revolution inner surfaces, and another using a cylindrical electrode and a pair of circular plate electrodes placed at both ends of the cylindrical electrodes. The former one having the hyperboloid-of-revolution inner surfaces can form a larger ion trapping region in the space surrounded by the electrodes, and the latter one using the cylindrical and circular plate electrodes has rather narrower ion trapping region. In any type of the ion trap device, the electrode surrounding circularly the ion trapping space is called a ring electrode, and the electrodes placed at both ends of the ring electrode are called end cap electrodes. Normally, the RF voltage is applied to the ring electrode to form the trapping electric field. In any type of the ion trap device, the mass to charge ratio of an ion determines whether it is securely and stably trapped in the ion trapping space, or it moves irregularly and collides with an inner surface of the electrodes or is ejected outside through an opening of the electrodes. The kinetics of the ions in the ion trapping space is described in detail in, for example, R. E. March and R. J. Hughes, "Quadrupole Storage Mass Spectrometry", John Wiley & Sons, 1989, pp. 31–110.

In a typical structure for applying an RF voltage to the ring electrode, a coil is connected to the ring electrode, where the inductance of the coil, the capacitance between the ring electrode and the pair of end cap electrodes and the capacitance of all the other elements constitute an LC resonant circuit. To the LC resonant circuit, an RF driver (or an RF exciting circuit) is connected directly or indirectly through a transformer coupling. In such a structure, a large amplitude RF voltage (RF high voltage) can be applied to the ring electrode with a small amplitude driving voltage owing to the high Q value of the LC resonant circuit. In order to enhance the amplifying efficiency of the LC resonant circuit, a tuning circuit including a variable capacitor is normally used to make the resonance frequency of the LC circuit coincide with the frequency of the RF driver.

When the temperature rises, the coil may swell and its inductance may change, or the capacitance of the variable capacitor may change. This causes the resonance frequency of the resonant circuit to shift from that of the RF driver. In one case, a high voltage switch is connected to the ring electrode. When the RF high voltage is changed, the capacitance of the high voltage switch may change and the resonance may break. Generally a feedback control is incorporated to fix the amplitude of the RF high voltage to a target value by adjusting the output voltage of the RF driver, so that the amplitude of the RF high voltage is stable irrespective of the shift of the resonance frequency.

But there arises an error, or a shift, in a relative phase between the output of the RF driver and the amplified RF high voltage. When some ion processing is made in the ion trap device using, or relating to, the phase of the RF high voltage, such as an ion selection processing or an ion dissociation processing, the phase of the RF voltage is deduced from the phase of the RF driver, and various timings are determined based on the phase thus determined. Thus, when there arises a shift in the relative phase between the output of the RF driver and the RF high voltage, the processing cannot be done properly or the precision of the processing deteriorates.

When, for example, an ion mass analysis is made by changing, or scanning, the amplitude of the RF high voltage, the timing when the ions are ejected from the ion trapping space is related to the phase of the RF high voltage. If there is a shift in the phase, the position of a peak or peaks of the mass spectrum shifts accordingly. When, for example, ions are extracted from an ion trap device to a TOF mass spectrometer, the position of a peak or peaks of the mass spectrum also shifts if there is a shift in the phase of the RF high voltage because ion's energy and direction of motion at a timing of extraction is closely related to the phase.

Such a problem can be solved, in principle, by monitoring (not the output of the RF driver but) the RF high voltage which is generated through amplification by resonance, detecting the phase of the RF high voltage directly, and then using the detected phase as the basis of the control. But, actually, it is very difficult to always detect an exact phase of the RF high voltage which alters in many ways. Even if it is possible in any way, it is too expensive to be practical. Another problem is that installing such a function to an existing mass spectrometer is practically impossible.

The present invention addresses the problem, and an object of the invention is to decrease the shift in the phase difference between the output of the RF driver and the RF high voltage. This will alleviate or prevent deterioration of the mass analysis or other processings using the ion trap device caused by the shift in the phase of the RF high voltage.

Thus an ion trap device according to the present invention includes:

a ring electrode and a pair of end cap electrodes;

an RF driver for generating a driving voltage with a driving frequency;

a resonant circuit for amplifying the driving voltage generated by the RF driver to produce an RF voltage applied to at least one of the electrodes; and a tuning circuit for changing a resonance frequency of the resonant circuit, wherein the tuning circuit is adjusted so that the resonance frequency is shifted from the driving frequency.

According to the present invention, in a method of tuning an ion trap device which includes a ring electrode and a pair of end cap electrodes, an RF driver for generating a driving voltage with a driving frequency, a resonant circuit for amplifying the driving voltage generated by the RF driver to produce an RF voltage applied to at least one of the electrodes, and a tuning circuit for changing a resonance frequency of the resonant circuit, the tuning circuit is adjusted so that the resonance frequency of the resonant circuit is shifted from the driving frequency.

The principle of the present invention is explained using FIG. 2, which shows a model diagram of an LCR series-resonance circuit. In the circuit, the capacitor 101 representative of the overall capacitance of the circuit including the capacitance formed between the electrodes is C. The inductance of the coil 102 is L, and the effective resistance 103 of the resonant circuit is R. The angular frequency of the driving voltage (output) of the RF driver 100 is $\omega$, and the angular resonance frequency of the resonant circuit is $\omega_0$. The impedance Z of the resonant circuit is:

$$Z=R+jX$$

where $X=\omega L-1/(\omega C)$. When $\omega=\omega_0$, the resonance condition is satisfied, and X=0. At this condition, the impedance Z reaches its minimum value of R. This means that the objective RF high voltage is obtained with a minimum driving voltage through amplification. The gain of the amplification is called the Q-value, which is given by $$Q=\omega_0 L/R.$$

In many ion trap devices, the Q-value of the resonant circuit is set at around 100–300.

When the driving voltage is $V_0$, the current I flowing through the resonant circuit is represented by $$I=V_0/Z.$$

The RF high voltage $V_{RF}$ generated between the electrodes of the ion trap device corresponds to the voltage across the capacitor C in the model circuit. Since the impedance of the capacitor C is represented by $$-j/(\omega C)\approx -j\omega_0 L,$$

the RF high voltage $V_{RF}$ is represented by $$V_{RF}=(-j\omega_0 L/Z)\cdot V_0.$$

Thus the phase difference $\theta$ between the output of the RF driver 100 and the RF high voltage is given by $$\theta=-\pi/2-\angle Z,$$

where $\angle Z$ is the angle of the impedance Z. By rewriting the reactance X to $$X=QR\cdot(\omega/\omega_0-\omega_0/\omega),$$

the angle of Z is given by $$\tan(\angle Z)=Q\cdot(\omega/\omega_0-\omega_0/\omega).$$

Differentiating both sides of the above equation by the angular frequency, the shift $\Delta\theta$ in the phase difference $\theta$ is given by $$\Delta\theta\approx 2Q\cdot\cos^2(\angle Z)\cdot(\Delta\omega/\omega_0)$$

This means that the phase shift $\Delta\theta$, caused by a fixed amount of the shift in the angular frequency $\Delta\omega$, can be decreased by shift of resonance frequency from the resonance condition $\angle Z=0$. For example, the phase shift $\Delta\theta$ is about 0.25 times (a quarter) at $\angle Z=60°$ compared to that in the resonance condition, i.e., $\angle Z=0$. The ratio decreases according to $\cos^2(\angle Z)$: for example, when $\angle Z=65°$, the ratio is 0.179, and when $\angle Z=70°$, the ratio is 0.117.

Thus, in the present invention, the resonance frequency of the resonant circuit, which is used to apply the RF high voltage to one of the electrodes of the ion trap device, is deliberately shifted from the frequency of the RF driver (driving frequency). This reduces the influence of the deviation in the resonance frequency caused by the change in the RF high voltage on the shift in the phase difference between the output of the RF driver and the RF high voltage. This minimizes the degradation of various performances of the ion trap device relating to the phase difference, such as the shift in the peaks of the mass spectrum and enhances the sensitivity and precision of the mass analysis of the mass spectrometers using the ion trap device.

If the phase difference between the output of the RF driver and the RF high voltage depends on the amplitude of the RF voltage, the resonant circuit may not be stable unless the shift of the resonance frequency from the resonance condition is made in a proper direction. For example, when a semiconductor device is connected to the electrode (or electrodes) to which the RF voltage is applied, the effective capacitance of the semiconductor device increases as the RF voltage increases, which leads to the decrease in the resonance frequency of the resonant circuit. Suppose that, in such a case, the resonance frequency of the resonant circuit is shifted in the direction of increasing frequency by decreasing the capacitance of the resonant circuit. If the amplitude of the RF high voltage is increased, the capacitance increases, which brings the resonant circuit toward the resonance condition. This increases the gain of the resonant circuit, and destabilize the resonance due to the positive feedback phenomenon.

Thus, when a semiconductor device is connected to the electrode (or electrodes) to which the RF high voltage is applied as described above, it is recommended to shift the resonance frequency in the direction of decreasing frequency by, for example, increasing the capacitance using a variable capacitor, which functions as the tuning circuit mentioned above. Generally speaking, when the resonance frequency shifts in a direction toward another frequency as the RF voltage increases, the tuning procedure should shift the resonance frequency of the resonant circuit in the same direction. This stabilizes the resonance.

BRIEF DESCRIPTION OF THE ATTACHED DRAWINGS

DETAILED DESCRIPTION OF A PREFERRED EMBODIMENT

Figure 1:
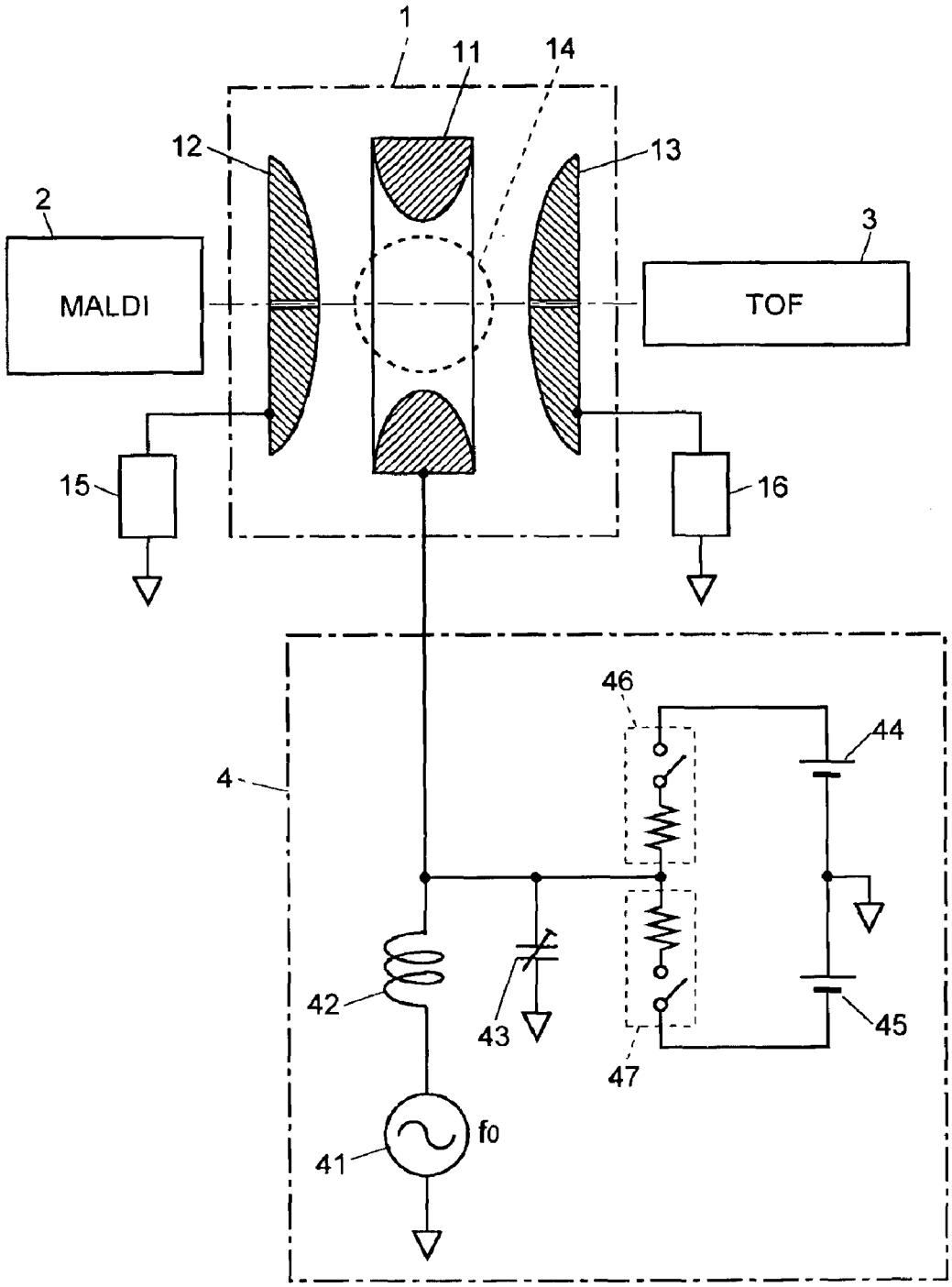
FIG. 1 is a schematic illustration of a mass spectrometer using an ion trap device according to the present invention.
Figure 2:
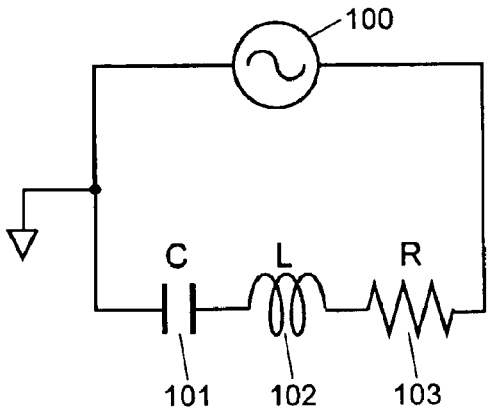
FIG. 2 is a diagram of a model circuit for LCR series resonance.

A time of flight mass spectrometer using an ion trap device embodying the present invention is described. FIG. 1 schematically shows the main part of the mass spectrometer, in which the ion trap device 1 is composed of a ring electrode 11 and a pair of end cap electrodes 12, 13 opposing each other with the ring electrode 11 between them. An RF high voltage is applied to the ring electrode 11, whereby a quadrupole electric field is formed within the space surrounded by the ring electrode 11 and the end cap electrodes 12, 13. The quadrupole electric field creates an ion trapping space 14 in which ions are trapped. End cap voltage generators 15 and 16 are respectively connected to the end cap electrodes 12 and 13 to apply appropriate voltages to them at every stage of an analysis.

For example, when ions produced by a MALDI (Matrix-Assisted Laser Desorption/Ionization) ion source 2 are introduced in an ion trap device 1, the voltages are applied to decrease the energy of the ions. When a mass analysis is conducted using a TOF (Time Of Flight) analyzer 3, the voltages are applied to and accelerate and extract ions from the ion trapping space 14 to the TOF analyzer 3. When it is intended to select and/or dissociate ions in the ion trapping space, the voltages are applied to generate such an electric field, in addition to the quadrupole electric field generated by the RF high voltage to trap ions, as to enable the selection and/or dissociation of ions in the ion trapping space.

A coil 42 is connected to the ring electrode 11, where the coil 42 is a part of a ring voltage generator 4 which is provided to apply the RF high voltage to the ring electrode 11. The coil 42 and the capacitance between (or capacitor created by) the ring electrode 11 and the end cap electrodes 12, 13 constitute an LC resonant circuit. Exactly saying, a voltage monitoring circuit (not shown) for the RF high voltage, a tuning circuit 43, the capacitance of the high voltage switches 46, 47, the capacitance of the wires connecting the elements and the inductance of the coil 42 all influence the resonance frequency.

There are several methods to drive a resonant circuit, including one using a transformer, etc. In the present embodiment, an end of the coil 42 is driven by an RF driver 41. The driving frequency of the RF driver 41 is fixed at 500 kHz, and the resonance frequency of the LC resonant circuit is controlled at around 500 kHz by adjusting the tuning circuit 43, so that the driving voltage is amplified to generate the RF high voltage. In the present embodiment, a vacuum variable capacitor is used in the tuning circuit 43, where the capacitance is changed to achieve tuning. Other known methods can be used to tune, of course. For example, a ferrite core can be used to change the inductance of the coil 42, which can also achieve tuning.

To the ring electrode 11, further, a pair of DC (direct current) high voltage current sources 44, 45 are connected via high voltage switches 46, 47, respectively. These sources are used to acutely increase the RF high voltage when ions are introduced in the ion trap device 1, or to abruptly decrease the RF high voltage when ions are ejected from the ion trap device 1. For example, when the RF high voltage is intended to abruptly raise in the negative polarity, the following process is taken.

First the high voltage switch 47 corresponding to the negative DC high voltage source 45 is closed, so that the voltage of the ring electrode 11 is set at the same voltage as the negative DC high voltage source. Then, within a short time, the high voltage switch 47 is opened. The resonant circuit then begins to resonate at the resonance frequency. When the resonance is intended to stop, both the high voltage switches 46 and 47 are closed, and the output of the RF driver 41 is set to zero. Since the absolute values of the voltage of the positive and negative DC high voltage sources 44 and 45 are the same, and the internal impedance of the switches 46 and 47 is the same, the RF high voltage becomes zero. After all the ions in the ion trap device 1 are extracted, both switches 46 and 47 are opened. The operation is described in detail in the paragraph [0011] of the Japanese Publication No. 2002-533881 of International Patent Application.

Since the high voltage switches 46 and 47 are required to operate at high-speed, semiconductor switches using, for example, the power MOSFETs are employed. Semiconductor devices used in such semiconductor switches, in general, have the characteristics that the capacitance increases as the voltage decreases. Thus, when the amplitude of the RF high voltage of the ring electrode 11 changes and, accordingly, the voltage applied to the high voltage switches 46, 47 changes, the capacitance of the switches 46, 47 also changes slightly. Normally, the amount of increase in the capacitance when the voltage applied to the high voltage switches 46, 47 decreases is larger than the amount of decrease in the capacitance when the voltage applied to the high voltage switches 46, 47 increases. Thus, though the RF high voltage applied to the ring electrode 11 alters sinusoidally with the polarity alternating symmetrically, the capacitance of the high voltage switches 46, 47 increases in average. And, as the amplitude of the RF high voltage applied to the ring electrode 11 increases, the increase in the capacitance of the high voltage switches 46, 47 becomes larger. This lowers the resonance frequency of the resonant circuit and shifts the resonant circuit from the predetermined resonance condition.

With the mass spectrometer of the present embodiment, the operator (or a controller) adjusts the tuning circuit 43 of the resonant circuit as follows:

(1) Set the target voltage of the RF high voltage to a low value.

Figure 3A:
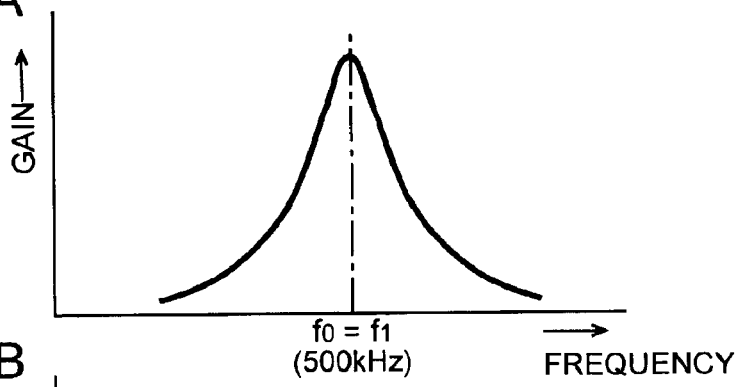
FIGS. 3A–3C are graphs schematically showing the relationship between the gain and the frequency of the resonant circuit.

(2) Adjust the value of the capacitance of the tuning circuit 43 so that the optimal condition is satisfied where the target voltage set at (1) is achieved and, at the same time, the driving voltage of the RF driver is minimum. At this time, the resonance frequency of the resonant circuit coincides with the frequency of the RF driver 41, i.e., the resonant circuit satisfies the resonance condition. FIG. 3A schematically shows the relationship between the frequency and the gain of the amplification in the resonant circuit. The frequency $f_0$ of the RF driver 41 and the resonance frequency $f_1$ of the resonant circuit coincide, and the gain of the resonant circuit is at its maximum.

(3) Set the target voltage of the RF high voltage at the largest value in the possible range.

Figure 3B:
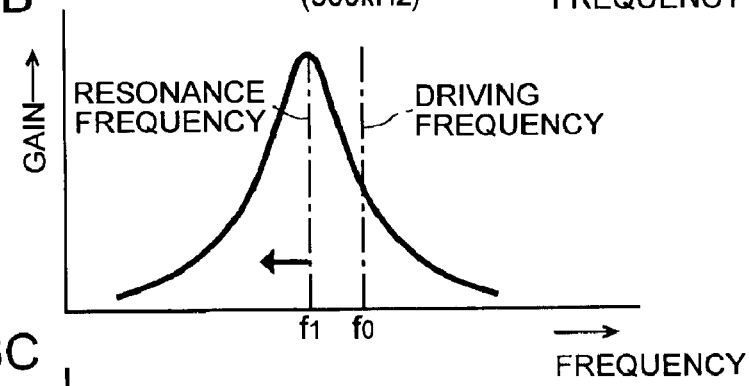

(4) Gradually increase the capacitance of the tuning circuit 43. As the capacitance increases, the resonance frequency $f_1$ decreases as shown in FIG. 3B, so that the gain at the frequency $f_0$ of the RF driver decreases. Owing to a feedback control, the RF high voltage is always controlled to adhere to the target voltage. Thus the driving voltage increases by an amount corresponding to the decrease in the gain. Then the capacitance of the tuning circuit 43 is set so that the driving voltage of the RF driver 41 reaches the maximum value in the possible range. By shifting the resonance frequency from the resonance condition, the change in the phase difference between the output waveform of the RF driver 41 and the waveform of the RF high voltage can be suppressed.

It is not necessary to do the above adjustment of the tuning circuit before every measurement operation, because, once an adjustment is made, the resonance condition hardly changes unless the apparatus is rebuilt for maintenance or for repair, or it is used for a long time. It is of course possible and causes no problem if the operator (or a controller) does the adjustment when he/she thinks it necessary.

Figure 3C:
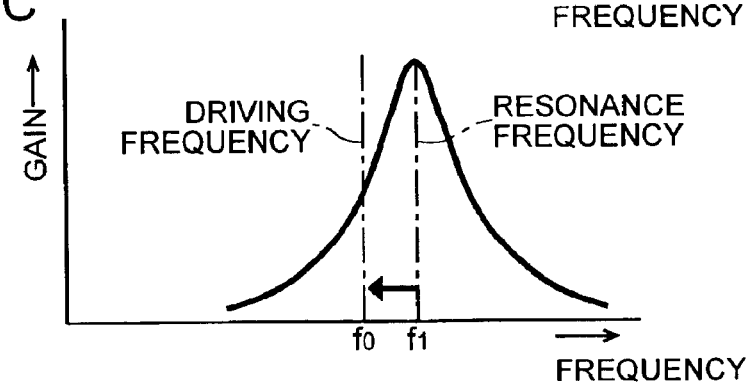

When the resonance frequency is shifted by increasing the capacitance of the tuning circuit 43, increase of the RF high voltage increases the capacitance of the high voltage switches 46 and 47. This decreases the gain of the resonant circuit, so that the resonance does not become unstable. If, on the other hand, the capacitance of the tuning circuit 43 is decreased in order to shift the resonance frequency to the other direction, the situation is as shown in FIG. 3C. When the RF high voltage is increased and capacitance of the high voltage switches 46 and 47 increases, the resonance frequency $f_1$ decreases toward the resonance condition, as shown by the arrow in FIG. 3C. This increases the gain, which further increases the RF high voltage even when the driving voltage is unchanged. That is, the resonant circuit becomes unstable due to the positive feedback, and the operation may become abnormal. Thus, it is important to increase, not decrease, the capacitance of the tuning circuit 43 to shift the resonance frequency from the resonance condition.

By shifting from the resonance condition, the output voltage of the RF driver 41 increases, as described before. This is caused by the increase in the reactance of the resonant circuit, but the electric energy consumed in the RF driver 41 is unchanged. The reason is as follows. When the RF high voltage is unchanged, the RF current is also unchanged irrespective of the resonance condition, so that the energy consumption is unchanged if the effective resistance of the resonant circuit is unchanged.

In the above ion trap device, the circuit is constructed so that the resonance frequency decreases when the RF high voltage is increased. In another construction where the resonance frequency increases when the RF high voltage is increased, the capacitance of the tuning circuit 43 should be decreased, contrary to the above case, to set the driving voltage of the RF driver 41 at the maximum value within the usable range for the largest value of the RF high voltage.

The above described embodiment is a mere example, and it is obvious for those skilled in the art to modify it or add unsubstantial elements to it within the scope of the present invention.

What is claimed is:

1. An ion trap device comprising:

a ring electrode and a pair of end cap electrodes;

an RF driver for generating a driving voltage with a driving frequency;

a resonant circuit for amplifying the driving voltage generated by the RF driver to produce an RF voltage applied to at least one of the electrodes; and a tuning circuit for changing a resonance frequency of the resonant circuit, wherein the tuning circuit is adjusted so that the resonance frequency is shifted from the driving frequency.

2. The ion trap device according to claim 1, wherein, if the resonance frequency deviates in a direction as the RF voltage increases, the resonance frequency of the resonant circuit is shifted in the same direction.

3. The ion trap device according to claim 1, wherein the tuning circuit uses a variable capacitor.

4. The ion trap device according to claim 1, wherein the tuning circuit uses a coil with a core, wherein the core is moved to change the resonance frequency.

5. A method of tuning an ion trap device comprising:

a ring electrode and a pair of end cap electrodes;

an RF driver for generating a driving voltage with a driving frequency;

a resonant circuit for amplifying the driving voltage generated by the RF driver to produce an RF voltage applied to at least one of the electrodes; and a tuning circuit for changing a resonance frequency of the resonant circuit, wherein the tuning circuit is adjusted so that the resonance frequency of the resonant circuit is shifted from the driving frequency.

6. The method of tuning an ion trap device according to claim 5, wherein, if the resonance frequency deviates in a direction as the RF voltage increases, the resonance frequency of the resonant circuit is shifted in the same direction.

7. The method of tuning an ion trap device according to claim 5, wherein the tuning circuit uses a variable capacitor.

8. The method of tuning an ion trap device according to claim 5, wherein the tuning circuit uses a coil with a core, wherein the core is moved to change the resonance frequency.

* * * * *